United States Patent [19]

Higgs

[11] 3,981,036

[45] Sept. 21, 1976

[54] LIFE SAVING BUOY FOR SMALL VESSELS

[75] Inventor: William York Higgs, Gibsons, Canada

[73] Assignee: Intercontinental Marine Limited, Canada

[22] Filed: Apr. 22, 1975

[21] Appl. No.: 570,364

[30] Foreign Application Priority Data

Apr. 22, 1974 United Kingdom ..... 17516/74

[52] U.S. Cl. ..... 9/9

[51] Int. Cl.[2] ..... B03B 21/52

[58] Field of Search ..... 9/8 R, 9, 10, 14

[56] References Cited

UNITED STATES PATENTS

| | | | |
|---|---|---|---|
| 1,032,207 | 7/1912 | Hambly | 9/9 |
| 1,137,782 | 5/1915 | Nixon | 9/9 |
| 1,372,591 | 3/1921 | Bichek | 9/9 |
| 1,384,412 | 7/1921 | Stoltz | 9/9 |
| 1,811,014 | 6/1931 | Kerwin | 9/9 |
| 2,118,466 | 5/1938 | Jennings | 9/9 |
| 2,341,799 | 2/1944 | Luby | 9/9 |
| 2,418,549 | 4/1947 | Derugeris | 9/9 |
| 3,703,736 | 11/1972 | Higgs | 9/9 |
| 3,905,060 | 9/1975 | Higgs | 9/9 |

*Primary Examiner*—Duane A. Reger
*Assistant Examiner*—Stuart M. Goldstein
*Attorney, Agent, or Firm*—Stevens, Davis, Miller & Mosher

[57] ABSTRACT

A life-saving buoy for small vessels such as yachts, fishing vessels and other small watercraft, which is mounted on the deck of the vessel in such a way as to release automatically if the vessel sinks, and including both light and radio beacons which come into operation automatically to signal the position of the buoy and of survivors. The buoy is connected at all times to the vessel by means of a cable carried by the buoy, the cable paying out as the vessel sinks away from the buoy, and this allows the buoy to serve as mooring means for life-saving equipment such as dinghies, liferafts, etc. released from the vessel. For this purpose, the buoy includes a mooring line normally stowed with the buoy, and released from the vessel with the buoy to stream out on the water away from the buoy. The buoy has a generally flat base and sides curving upwardly from the base so that the base is the widest part of the buoy, and the mooring line has an end connected to the base of the buoy inwardly from its outer rim, preferably by means of a ring which surrounds the anchoring cable at a point near to the buoy.

14 Claims, 4 Drawing Figures

LIFE SAVING BUOY FOR SMALL VESSELS

This invention relates to life-saving apparatus for vessels, and particularly to improvements in the inventions described in my Canadian Pat. No. 849,286 dated Aug. 18, 1970, and in my Canadian Pat. No. 964,126 issued Mar. 11, 1975. These inventions are concerned with a buoy which is suitable for being carried by a vessel in a manner permitting release and floatation of the buoy should the vessel sink, said buoy including a body having sufficient buoyancy to cause the buoy and parts carried thereby to float free from the sinking vessel, an anchoring cable of adequate strength to act as an anchor cable initially carried by the buoy, the cable being connected with the buoy and for connection with the vessel so as to maintain connection between the floating buoy and the vessel after this has sunk. A buoy of this type will hereinafter be referred to as being "of the type described."

The buoys described in the aforesaid patents include both light and radio beacons which automatically give distress signals when the buoy is floating in the water. Also, a particular feature of the aforesaid patent was the use of a buoyant mooring line which is relatively long compared to the dimensions of the buoy and which is normally stowed on the buoy, but which is released automatically when the buoy separates from the vessel to stream out on the water and to provide mooring means for buoyant equipment such as life-boats, life-rafts, etc. released from the vessel. The buoyant equipment held in this way remains in marshalled condition in the vicinity of the sunken vessel and can easily be located by the beacons described, and this arrangement provides the further advantage that the buoyant equipment stays head-on to the wind and sea so that the risk of upset is minimized.

The present invention provides modifications, of the buoys described in the aforesaid patents which render the buoy particularly suitable for use on small vessel.

In accordance with one aspect of the present invention, in a life-saving buoy of the type described, the buoy has a generally flat base and sides curving continuously inwardly and upwardly from the base so that the base is the widest part of the buoy, and such that the overall height of the buoy is considerably less than the maximum width of the base, the weight distribution of parts within the buoy being such that the buoy normally floats with its base lowermost and substantially level, and there is provided a life-boat mooring line normally stowed with the buoy and releasable from the vessel therewith, the mooring line being of adequate strength for mooring of a boat or life-raft thereto, and an end of the mooring line is connected to the base of the buoy inwardly of the outer rim of the base. Preferably, the end of the mooring line is connected to a central position on the base of the buoy.

The buoy of the shape described is particularly suitable for use on the decks of yachts and all small vessels, since the inwardly curved sides of the buoy do not tend to catch the sheets and other working ropes which must continually be moved around the deck of such vessels. Also, with this shape the buoy is not easily displaced from its mount on the deck by the action of water sweeping across the deck as the vessel heels, or as a small craft ships waves.

A preferred form of buoy is of generally hemispherical shape, and has a height which is between 60% and 65% of its maximum diameter. Although this particular shape is not essential, it is very desirable for purposes indicated above that the sides of the buoy body should curve in continuously from the base. This term is intended to mean a general increase in inward curvature with increasing height from the base of the buoy, and also means that there are no substantially vertical interruptions of this curvature, such as would cause ropes moving across the deck to catch on the buoy.

Although the buoy is streamlined in respect of waves sweeping over the deck of the vessel, when the buoy is in operation in the water, and holding a life-boat by its mooring line, the arrangement described ensures that the buoy presents a good resistance to being pulled through the water. This is because the connection of the mooring line to the base of the buoy inwardly of its outer rim, and preferably near to its center, allows the buoy to tilt slightly away from the direction of pull on the mooring line so that the base of the buoy is inclined to the direction of movement through the water and resists this movement. Nevertheless, the arrangement is such that the buoy does not tilt sufficiently to interfere seriously with the operation of an antenna which extends up from the top of the buoy.

The term "life-boat mooring line" as used in this specification will be understood as meaning a line suitable for small boats or rafts normally carried by small vessels or yachts.

In accordance with another aspect of the invention, in a life-saving buoy of the type described, and in which there is provided a mooring line normally stowed with the buoy and released from the vessel therewith, an end of the mooring line is connected to a ring surrounding the anchoring cable so that after release from its stowed position the mooring line is held in position relative to the buoy by this ring. Preferably, buoyant means are provided arranged to support this ring close to the buoy when the vessel has sunk. The ring may alternatively be incorporated in a pad of buoyant material attached to the under side of the buoy, the buoyant material supporting the ring if the pad breaks away from the buoy under the influence of tension applied by the mooring line. In this case, the ring acts as a fairlead or guide while the anchoring cable is being deployed. With this arrangement, the stresses applied by the life boat mooring line on the buoy are minimized.

Preferably, the mooring line is normally stowed within an enclosure by which it is protected from the weather and from damage. In accordance with a further aspect of the invention in a life-saving buoy of the type described, and having a life-boat mooring line normally stowed with the buoy and released from the vessel therewith, the mooring line is stowed in an enclosed space between the base of the buoy and a support for the buoy, the sides of the space being enclosed by a skirt extending downwardly from the sides of the buoy, the mooring line being of adequate strength for mooring of a boat or life-raft thereto.

The invention will be described by way of example with reference to the accompanying drawings, in which.

Figure 1:
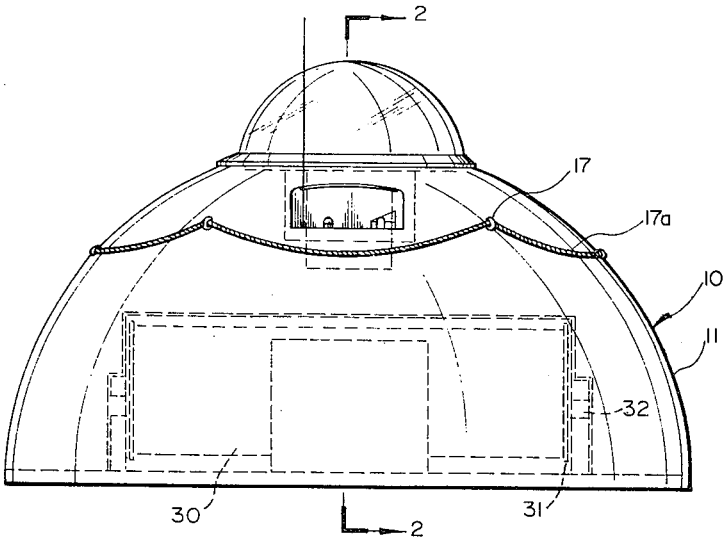
FIG. 1 shows a side elevation of the buoy itself.
Figure 2:
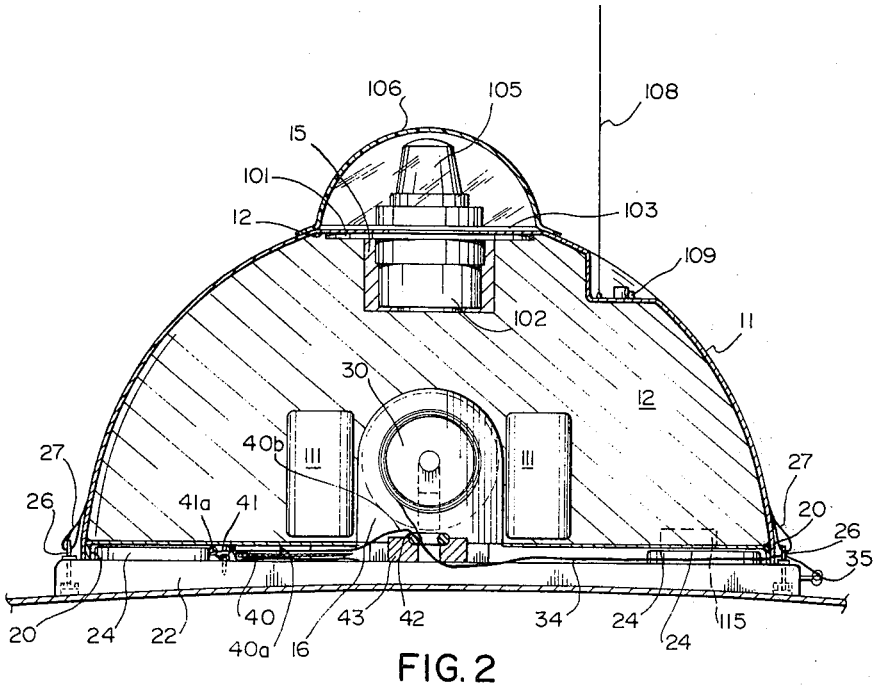
FIG. 2 shows a sectional elevation on lines 2-2 of FIG. 1, which shows the buoy mounted on a special mounting.

The buoy as shown in FIGS. 1 and 2 includes a buoy body 10 having an outer casing 11 of fire resistant molded glass fiber reinforced plastics which encloses floatation means formed by a filling of closed-pore foamed synthetic material 12, which is such as to provide buoyancy even if the outer casing is punctured or otherwise damaged. The body 10 is of hemi-spherical shape, having a generally flat base and sides curving inwardly and upwardly from the base so that the base is the widest part of the buoy body. The body has a flattened portion 12 at the top, and the top is also centrally recessed at 15, to accommodate a light beacon and radio transmitter as will be described in more detail. Also, the base of the body is centrally recessed at 16 to accommodate a cable reel which will be described below. The sides of the body, near to the top of the buoy, are provided with a series of eyes 17 spaced around the buoy and which hold a looped length of polypropylene line 17*a*, which provides arm loops suitable for being grasped by survivors when the buoy is in the water.

The base of the body is provided with an integral short skirt 20 extending down from the perimeter of the casing 11. As shown in FIG. 2, this skirt is arranged to cooperate with a flat support surface on the upper side of a mounting pad 22 to provide a narrow enclosed space under the base of the buoy. The mounting pad 22 has a lower surface curved to lie on a curved deck of a vessel. Four blocks 24 are provided spaced around the pad 22 and which locate against the inside of the skirt 20 to locate the buoy in position and to provide stowage space for a life-boat mooring line and its light. Four eye bolts 26 are provided spaced around the outer margin of the pad 22, outside the skirt 20, and these serve to hold the ends of two cords 27 which are fixed to eyes 26 and which normally hold the buoy in place on the pad 22 which is itself securely fixed to the deck. The cords 27 are pre-tested lines arranged to break at a pre-tested tension of about ten pounds so that if the vessel sinks rapidly the buoy will break free from the cords and remain on the surface. The cords are sufficiently strong to prevent the buoy from being dislodged by wind or by water sweeping over the deck, since the shape of the buoy inhibits its lifting by such forces.

The recess 16 accommodates a cable reel 30 indicated in side view in FIG. 1 and in cross-section in FIG. 2. The reel is formed of aluminum, having a central cylindrical shaft portion carrying cable 34, and radial end flanges 31, and the reel is mounted on a shaft which projects through the end plates at each end, the projecting ends being carried by bearings 32 mounted in the end walls of the recess 16. The bearings 32 are of nylon or Teflon (Trademark for polytetrafluoroethylene) and are split bearings, the lower half of at least one of the bearings being carried by a mounting movable by a screwed plug acting on the mounting to urge the two halves of the bearing together against the reel spindle to prevent free rotation of this spindle. The bearing pressure is adjusted to provide a braking force equivalent to a tension of about 5 pounds in the anchoring cable 34. The reel carries a 3,000 feet length of the steel cable 34 of 5/64 inch diameter with minimum breaking strength of 800 pounds. The inner end of the cable is attached to the reel, and the outer end passes through a groove in pad 22 under skirt 20 and is fixed by a spring snap hook to an eye bolt 35 securely fixed to an outer edge of the pad 22, so as to be readily disconnectible from the pad. The reel is rotatable sufficiently freely so that if the vessel sinks, the buoy can remain on the surface of the water and still be attached to the vessel by means of the cable 34 which is paid out by the reel as the vessel sinks.

An important feature of the buoy, as with the buoys of Canadian Pat. Nos. 849,286 and 964,126 referred to above, is the provision of a life-boat mooring line, connected to the buoy, and normally held in a stowed position, and which is released from the stowed position to stream out on the water when the buoy has left the vessel. As explained, this allows the buoy to serve as an anchorage point for life-rafts or other buoyant equipment, to prevent these being separated from the buoy, and also maintains such buoyant equipment in a head-to-weather condition and reduces the risk of upset of that equipment.

Figure 3:
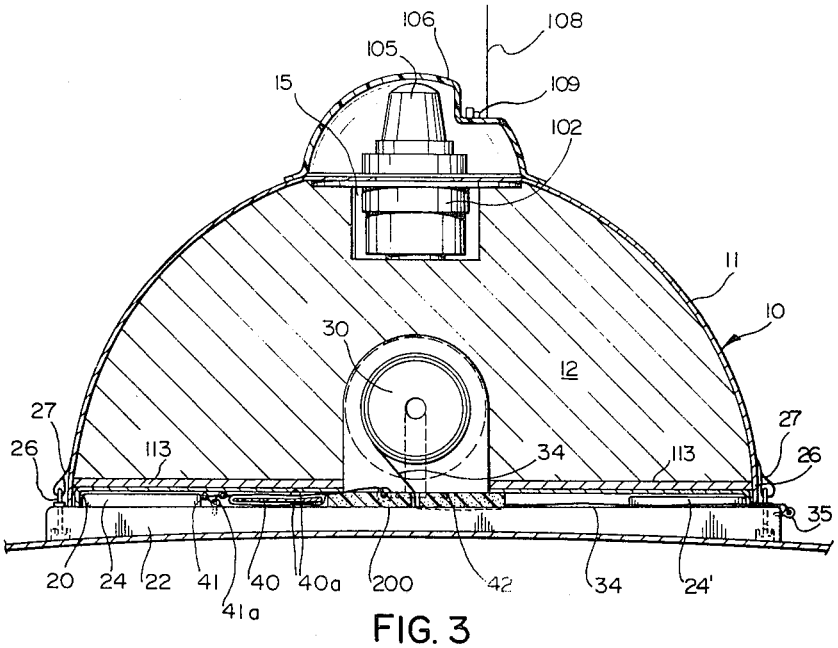
FIG. 3 shows a sectional elevational of a second embodiment of buoy.

The life-boat mooring line used with the buoy of this invention is a 25 foot length of half inch diameter polypropylene line 40 with an eye at its outer end and which is normally fleeted and parcelled as shown in FIG. 3 under the base of the buoy, being held onto the buoy by lengths of cord 40*a* pretested to break at 5 pounds tension. The mooring line is accommodated in the space between the buoy and the pad 22, and is buoyant and of adequate strength for mooring of a boat or life-raft thereto. A rip cord 41 is provided having an outer end connected to an eye 41*a* carried by pad 22, and having an inner end portion formed into a loop which passes around all the breakaway cords 40*a* behind the mooring line 40. The mooring line stowing arrangement is the same as that illustrated in FIG. 4 which shows a further embodiment but in which the mooring line is stowed in the same way. The rip cord is cut to a length which is chosen so as to be greater than the height of the uppermost rigging of the vessel above the point of installation of the buoy, and its intermediate length (between the outer end and the inner end portion) is stowed between pad 22 and the buoy base. The arrangement is such that after release of the buoy from the vessel the rip cord is pulled out to its full length as the vessel sinks, and only when the full length of the rip cord has been pulled out does this break the cords 40*a* to release the mooring line. Delayed deployment of the mooring line prevents fouling of this with the vessel rigging. The buoy will be sold with a rip cord 75 feet long as standard, which will be cut off to an appropriate length when the buoy is installed.

An inner end of the mooring line is connected to a stainless steel ring 42 which surrounds the cable 34 at a point near to the reel. The ring 42 is supported by a buoyant pad 43 having a hole through which the anchoring cable 34 passes, this pad 43 also being accommodated in the space between the buoy and the pad 22. The buoyancy of this pad 43 is such as to hold the ring 42 close to the buoy after the buoy has released from the vessel, the cable 34 being free to move through the ring 42 and pad 43. Thus, the mooring line in operation is effectively anchored by the cable 34, by means of which cable the mooring line is connected to a central position on the buoy base, and the buoy itself may be made of very light construction without any danger of damage being caused to it by a strong tension on the mooring line. The inner end portion of the mooring line, which is likely to come into contact with parts of the buoy when the mooring line is in use, is constituted by a portion of stainless steel wire cable 40*b* which is resistant to wear.

Figure 4:
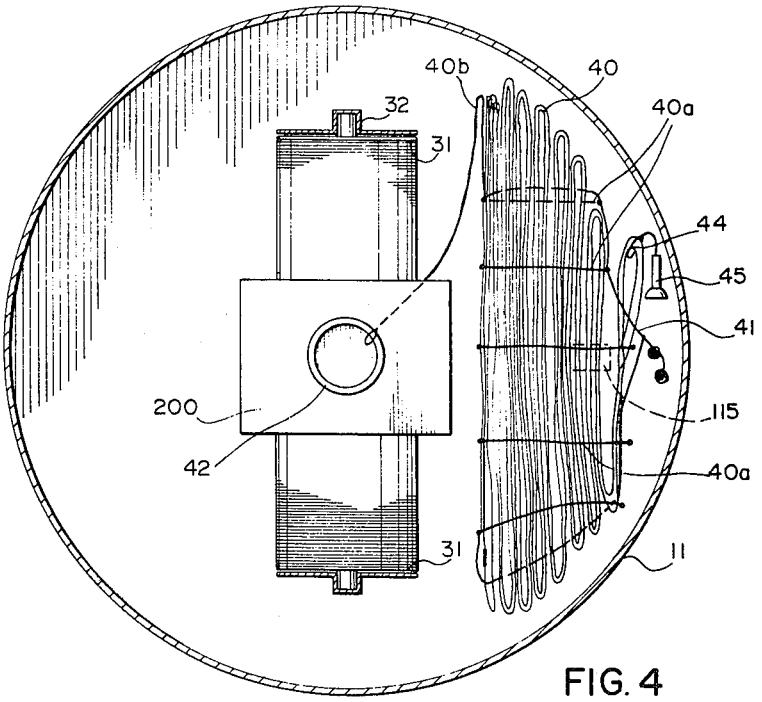
FIG. 4 shows a view of the underside of the buoy of FIG. 3.

The mooring line 40 has a strong eye 44 spliced to its outer end, and this eye carries a water-activated light similar to item 45 shown in FIG. 4 which will assist location of the outer end of the line.

The buoy also includes signalling means which operate automatically to send out distress signals and to assist in location of the survivors. Thus, the flat top surface 12 of the buoy body receives the outer margin of a lower mounting plate 101 which supports an electronics cannister 102 contained in recess 15. Integral with plate 101 is an upper plate 103 which supports a strobe light 105 of the high intensity Xenon type, as used on aircraft for collision avoidance. The cannister and the light are covered by a clear Lucite dome 106, which seals against the casing 11 to prevent ingress of moisture into the dome or into the cannister. The light 105 is connected to a solid state driving circuit within the cannister 102 which causes the light to produce ten flashes per minute with a peak intensity of 1,000,000 foot candles. By the use of a Fresnel lens, the range of this light is between 15 and 25 miles under average conditions.

The electronics cannister also contains a radio transmitter which is connected to an antenna 108 extending upwardly from a recessed portion in the upper side of the body. When activated the transmitter provides a distress and homing signal approved under international regulations. The recess for the antenna also contains switches 109 which may be used either for testing the radio, or for operating this in an emergency when the buoy is still in position on the vessel.

The light and radio transmitter are energized by two batteries 111 mounted inside body 10 at the center of each side of the lower recess 16. Suitable batteries are Ever-Ready (trademark) No. 520 6 volt batteries. These batteries are positioned centrally and at the base of the buoy to provide ballast and to stabilize the buoy, the weight distribution of the whole buoy being such that it floats with its base lowermost and level. The driving circuit for the light and the transmitter in cannister 102 are connected to the batteries 111 via a magnetic switch 115 which is shown ghosted in FIG. 2. This magnetic switch is positioned close to the base of the body and at one side, and is completely sealed within the body. The switch 115 is positioned so that it can be held in the open position by the magnetic effect of a galvinized sheet steel plate 24' secured to the top of one of the pads 24. The switch is spring biased so as to move to the closed position when the buoy is removed from the pad 22, and in its closed position the switch connects the light driving circuit and the transmitter to the batteries 111.

It will be appreciated from FIG. 2 that the buoy itself, the pad 22 with pads 24 and bolts 26, the anchoring cable 34 and eye bolt 35, and the mooring line 40 and associated parts can all be sold together as a unit which is very easily installed on the deck of a boat by merely attaching the pad 22 to the deck.

In operation, the switches 109 are used for periodic maintenance checks on the buoy, and to trigger the radio transmitter should the vessel become disabled and need help or in the event of a power failure with resultant radio silence, and if the vessel sinks the electronics may be triggered before launching the buoy.

If the vessel becomes in distress, the buoy can easily be launched by cutting, breaking, or untying the cords 27, the buoy being light enough to be easily lifted and launched over the side.

Should the vessel sink suddenly, however, immersion or partial immersion of the buoy will cause the cords 27 to break and thus release the buoy, allowing this to remain on the surface of the water as the vessel sinks. When the buoy has separated from the vessel by an amount corresponding to the length of rip cord 41, this breaks the cords **40*a* releasing the mooring line 40 which is spread out by wave action and, being buoyant, streams out downwind of the buoy. The rip cord 40, since it is passed around cords 40*a* behind the mooring line, constitutes means arranged to dislodge the mooring line from the space underneath the base of the buoy after the buoy has separated from the vessel by a predetermined amount, so that the mooring line cannot possibly remain lodged under the buoy. The buoyant pad 43 holds the ring 42 close to the buoy. The eye 44 of the mooring line provides a convenient mooring point for any life rafts, dinghies, etc. which have been released or floated free of the vessel. Buoyant equipment may moor to the eye with varying lengths of painters, or may moor one behind the other to avoid collisions between such equipment. In stormy conditions, it is much easier for life rafts and other craft to moor to a floating line, than to a bobbing buoy. Swimmers can also grab the mooring line to assist them to the arm loops 17** on the buoy for temporary support if no buoyant equipment is available.

The separation of the buoy from the pad 22 allows the magnetic switch 115 to close, energizing both the radio transmitter and strobe light 105, which then commence to send out distress and homing signals. Thus survivors who are in life-rafts etc. connected to the mooring line, or who are clinging to the buoy, can be located reasonably soon and without the long delays usually associated with searching for scattered survivors. Since the buoy remains anchored by cable 34 to the vessel, the life rafts are also held in a head-to-weather condition, and prevented from being upset or swept away far out to sea or onto inhospitable shores. After rescue, the buoy serves to locate the sunken vessel for rapid salvage, wreck marking and pollution control.

The manner in which the life-boat mooring line is connected to the buoy, via a ring surrounding the anchoring cable 34 which is supported by a buoyant pad, is such as to provide proper anchoring of the mooring line without imposing undue stress directly on the buoy. When a horizontal pull is applied to the buoy by the mooring line acting on the anchoring cable, the resultant sideways movement of the buoy through the water tends to tilt this slightly, so that the buoy becomes orientated in a manner which resists such sideways movement; the buoy thus holds the mooring line much more firmly than if this were attached to one of its sides. Also, this arrangement holds the mooring line in a cushioned manner, since sudden strong pulls on the mooring line will cause ring 42 to pull directly on the cable without subjecting the buoy to large acceleration forces on jerking by virtue of the catenary of the anchoring cable.

The buoy shown in FIGS. 3 and 4 is generally similar to that described above, and the same reference numerals are used to denote corresponding parts.

One difference of the buoy shown in FIGS. 3 and 4, as compared to the first buoy, is that the batteries which operate both the strobe light 105 and the radio transmitter are small batteries contained in the electronics cannister 102. Suitable ballast is provided by a metal plate 113 fitted inside the base of the buoy around the recess 16. Instead of the magnetic switch previously described, a mechanical switch operated by a rip cord attached to pad 22 may be used. Also, the antenna 108, and test switches 109, are mounted in a recess in the side of Lucite dome 106. With this arrangement, the radio, light, batteries, antenna and switches are all in a single component which is removable for servicing.

A further difference with this second embodiment is that the ring 42 holding the inner end of the mooring line, instead of being loose on the anchoring cable, is embedded in the top of a pad 200 of foam plastics material which has a central hole corresponding to the aperture in ring 42 and which is lightly affixed to the base of the buoy, bridging recess 16. On release of the buoy from the vessel, the pad 200 remains attached to the buoy provided that conditions are relatively calm, and the ring 42, being fixed in position, provides a fairlead for the anchoring cable as it leaves the reel. If the mooring line is subjected to strong stresses, in heavy weather conditions, the pad 200 breaks away from the base of the buoy without damaging the base, and the ring remains supported near the base of the buoy by the pad 200, so that forces on the mooring line are transmitted to the buoy via the anchoring cable, as with the first embodiment.

The buoy as disclosed may also incorporate radar reflective material within its outer casing, to aid location.

The friction brake on the reel afforded by the split bearing arrangement described may be augmented or replaced by vanes on the flanges of the cable reel which cause braking by churning the water in which the buoy is floating.

As an alternative to the use of a cable reel, the anchoring cable may be held on static spool mounted with vertical axis in a recess in the bottom of the buoy, the spool being arranged to pay out the anchoring cable from its inside core, the spool being similar in nature to those known for string. Also, although steel cable is preferred for the anchoring cable, a nylon or polypropylene cable may be used.

I claim:

1. A life-saving buoy suitable for being carried by a vessel in a manner permitting release of the buoy should the vessel sink, and having sufficient buoyancy to cause the buoy and parts carried by the buoy to float off the vessel when the vessel sinks, and including an anchoring cable initially carried by the buoy having its free outer end attachable to the vessel and its inner end connected to the buoy, whereby upon sinking of the vessel the buoy is released from the vessel and remains on the surface of the water while the vessel sinks with the cable being paid out from the buoy so that the cable maintains connection between the buoy and the vessel, wherein said buoy has a generally flat base surrounded by an outer rim and sides curving continuously inwardly and upwardly from the base so that the base is the widest part of the buoy, and such that the overall height of the buoy body is considerably less than the maximum width of the base, the weight distribution of parts within the buoy being such that the buoy normally floats with its base lowermost and substantially level, and wherein there is provided a life-boat mooring line normally stowed with the buoy and releasable from the vessel therewith, said mooring line being of adequate strength for mooring of a boat or life-raft thereto, an end of said mooring line being connected to the base of said buoy at a connection point disposed inwardly of the outer rim of the base.

2. A life-saving buoy according to claim 1, wherein said end of said mooring line is connected to a central position on the base of the buoy.

3. A life-saving buoy according to claim 3, wherein said end of the mooring line is connected to a ring surrounding said anchoring cable whereby after release from its stowed position the mooring line is held in position relative to the anchoring cable.

4. A life-saving buoy suitable for being carried by a vessel in a manner permitting release of the buoy should the vessel sink, and having sufficient buoyancy to cause the buoy and parts carried by the buoy to float when the vessel sinks, and including a cable reel rotatably carried by the buoy and an anchoring cable initially carried by the reel having its free outer end attachable to the vessel, whereby upon the sinking of the vessel the buoy is released from the vessel and remains on the surface of the water while the vessel sinks with the cable being paid out by the reel so that the cable maintains connection between the buoy and the vessel, said buoy having floatation means incorporated in the buoy body having a generally flat base and sides curving inwardly and upwardly from said base so that the base is the widest part of the buoy body, and said cable reel being incorporated in a central recess in said base, and wherein there is provided a mooring line normally stowed under the base of said buoy so as to be free to stream out from the buoy when the buoy is released from the vessel, said mooring line being of adequate strength for mooring of a boat or life-raft thereto, an end of said mooring line being connected to a ring surrounding said anchoring cable whereby after release from its stowed position said mooring line is held in position relative to the buoy.

5. A life-saving buoy according to claim 4 wherein there is provided buoyant means independent of the buoy body arranged to support said ring close to the buoy when the vessel has sunk.

6. A life-saving buoy according to claim 4 wherein said buoy has a skirt extending down from the perimeter of said buoy, said skirt being arranged to co-operate with a flat support surface to provide an enclosed space wherein said mooring line and ring may be stowed.

7. A life-saving buoy having a base, said buoy suitable for being carried by a vessel in a manner permitting release of the buoy should the vessel sink, and having sufficient buoyancy to cause the buoy and parts carried by the buoy to float off the vessel when the vessel sinks, and including an anchoring cable initially carried by the buoy having its free outer end attachable to the vessel and its inner end connected to the buoy, whereby upon sinking of the vessel the buoy is released from the vessel and remains on the surface of the water while the vessel sinks with the cable being paid out from the buoy so that the cable maintains connection between the buoy and the vessel, wherein there is provided a life-boat mooring line normally totally enclosed in a space between the base of the buoy and a support therefor, the sides of said space being enclosed by a skirt extending downwardly from the sides of said buoy, said space being shallow relative to the height of the buoy and being free of any moving parts, said mooring line being of adequate strength for mooring of a boat or life-raft thereto.

8. A life-saving buoy according to claim 1 wherein said anchoring cable is held on the buoy by a cable reel, said cable reel being carried by bearing means including two relatively movable bearing parts holding journals at the ends of said reel and means for urging said parts together whereby friction may be applied to the reel to prevent free rotation of the reel.

9. Life-saving equipment for vessels including a buoy according to claim 1, in combination with mounting means arranged for permanent fixing to the vessel and serving to locate the buoy, said mounting means being associated with retaining means for hold-down elements which normally secure the buoy to the vessel, said hold-down elements being constituted by breakable cords which are caused to break by the buoyancy of the buoy upon submergence of the buoy.

10. A life-saving buoy suitable for being carried by a vessel in a manner permitting release of the buoy should the vessel sink, and having sufficient buoyancy to cause the buoy and parts carried by the buoy to float when the vessel sinks, and including a cable reel rotatably carried by the buoy and an anchoring cable initially carried by the reel having its free outer end attachable to the vessel, whereby upon the sinking of the vessel the buoy is released from the vessel and remains on the surface of the water while the vessel sinks with the cable being paid out by the reel so that the cable maintains connection between the buoy and the vessel, said buoy having floatation means incorporated in the buoy body and having a generally flat base and sides curving inwardly and upwardly from said base so that the base is the widest part of the buoy body, and said cable reel being incorporated in a central recess in said base, and wherein there is provided a mooring line normally stowed under the base of said buoy so as to be free to stream out from the buoy when the buoy is released from the vessel, said mooring line being of adequate strength for mooring of a boat or life-raft thereto, an end of said mooring line being connected to a ring surrounding said anchoring cable, said ring being incorporated in a pad of buoyant material attached to the underside of said buoy, whereby after release from its stowed position said mooring line is held in position relative to the buoy.

11. A life-saving buoy having a base, said buoy suitable for being carried by a vessel in a manner permitting release of the buoy should the vessel sink, and having sufficient buoyancy to cause the buoy and parts carried by the buoy to float off the vessel when the vessel sinks, and, including an anchoring cable initially carried by the buoy having its free outer end attachable to the vessel and its inner end connected to the buoy, whereby upon sinking of the vessel the buoy is released from the vessel and remains on the surface of the water while the vessel sinks with the cable being paid out from the buoy so that the cable maintains connection between the buoy and the vessel, wherein there is provided a life-boat mooring line normally stowed in an enclosed space between the base of the buoy and a support therefor, the sides of said space being enclosed by a skirt extending downwardly from the sides of said buoy, said mooring line being of adequate strength for mooring of a boat or life-raft thereto, and said mooring line being fleeted in positioin on the underside of the buoy base and held in position by breakaway cords, and wherein a rip cord is provided cut to a length greater than the height of the vessel rigging above the point of installation of the buoy, said rip cord having an inner end portion arranged to break said breakaway cords when extended to its full length and having an outer end for attachment to the vessel, the intermediate length of said rip cord being stowed so that on release of the buoy from the vessel the release of the mooring line is delayed until the rip cord has been pulled out to its full length.

12. A life-saving buoy according to claim 1, wherein said buoy body has a generally hemi-spherical shape.

13. A life-saving buoy according to claim 7, wherein means are provided interconnecting the vessel and the stowed mooring line and arranged to dislodge the mooring line from said space after the buoy has separated from the vessel by a predetermined amount.

14. A life-saving buoy according to claim 11, wherein said rip cord is arranged to dislodge the mooring line from said space after the buoy has separated from the vessel by a predetermined amount.

* * * * *